United States Patent [19]

Fukazawa

[11] Patent Number: 4,864,978

[45] Date of Patent: Sep. 12, 1989

[54] MANIFOLD AND MANUFACTURING METHOD THEREOF

[75] Inventor: Kazuhito Fukazawa, Yokohama, Japan

[73] Assignees: Mitsui & Co., Ltd., Tokyo; Kokan Kako Co., Ltd., Yokohama, both of Japan

[21] Appl. No.: 112,883

[22] Filed: Oct. 27, 1987

[51] Int. Cl.[4] ..... F02M 75/18

[52] U.S. Cl. ..... 123/52 M; 123/52 MC

[58] Field of Search ..... 123/52 M, 52 MC, 52 MB, 123/52 MV

[56] References Cited

FOREIGN PATENT DOCUMENTS

| | | | |
|---|---|---|---|
| 0251180 | 1/1988 | European Pat. Off. | 123/52 M |
| 2742616 | 3/1979 | Fed. Rep. of Germany | 123/52 MC |
| 2824205 | 12/1979 | Fed. Rep. of Germany | 123/52 M |
| 663897 | 8/1929 | France | 123/52 M |
| 1286368 | 1/1962 | France | 123/52 M |
| 42-18757 | 9/1967 | Japan . | |
| 0009914 | 1/1978 | Japan | 123/52 M |
| 57-206530 | 12/1982 | Japan . | |
| 354880 | 8/1931 | United Kingdom | 123/52 M |

OTHER PUBLICATIONS

"Pipe Processing Method", pp. 132–133, published Sep. 30, 1982.

*Primary Examiner*—David A. Okonsky

*Attorney, Agent, or Firm*—Spencer & Frank

[57] ABSTRACT

A structure and a method of manufacture of a manifold which is to be mounted either on the intake side or on the exhaust side of an internal combustion engine, which is formed by projecting branch pipes from one side of a pipe member in the form of straight pipes. The manifold is further provided with grooves for gas leakage prevention and for rotation prevention at the connection between branch pipes and flanges caulked to the free ends thereof.

9 Claims, 1 Drawing Sheet

MANIFOLD AND MANUFACTURING METHOD THEREOF

BACKGROUND OF THE INVENTION

1. Field of the Invention

This invention relates to a manifold which is branched out to connect valves of an internal combustion engine of an automobile with either a carburetor or a muffler, and a manufacturing method therefor.

2. Prior Art

There is generally known in the art a manifold for intake/exhaust systems of an internal combustion engine comprising a manifold main body, branched pipes connected to respective cylinders, and flanges for fixing these branched pipes on cylinder blocks, which are cast-molded and are further cladded on the outer periphery thereof for reinforcement purpose, particularly for an exhaust manifold which contains gases of high temperature and pressure. The conventional manifold however, is defective in that the weight of a manifold itself is heavy and adds an extra weight and size to an internal combustion engine to thereby give limitations to the engine layout design.

OBJECTS AND SUMMARY OF THE INVENTION

The present invention was conceived to eliminate these problems encountered in the prior art, and aims to provide a manifold which is light in weight and small in size to reduce the molding cost by structuring it with pipe members instead of casting.

In order to solve the aforementioned problems, one aspect of the invention relates to a manifold comprising a manifold main body constructed with a pipe member, plural branch pipes projecting from a side of the pipe member, in the direction perpendicular to the axial line of the pipe member, and flanges which are attached on the ends of these branch pipes, which is characterized in that either the outer peripheries of said branch pipes at ends thereof or the inner peripheries of the flanges which are inserted into the ends of the branch pipes are provided with grooves for preventing gas from leaking therefrom and grooves for preventing rotation, and the outer peripheries of the branch pipes are caulked with pressure over the inner peripheries of the flanges.

A second aspect of the invention relates to a manufacturing method of manifolds comprising the steps of: forming with the bulging process (hydraulic bulge forming or bulge working) plural pipes on one side of a pipe member in a manner to project therefrom in the direction perpendicular to the axial line of the pipe; forming branch pipes by boring a hole on the ends of each projected pipe formed by the bulging process, and rectifying the periphery to define straight pipe projections; forming circumferential grooves for gas leakage prevention and grooves for rotation prevention with either one of the outer peripheries of the branch pipes at the ends thereof and the inner peripheries of the flanges on which the ends of the branch pipes being cupped; and forming flanges by pressing and caulking the peripheries of the branch pipes at the ends over the inner peripheries of the flange members.

The manifold constructed as above is remarkably lighter and smaller than those in the prior art, as the main body and the branched pipes are formed integrally from a pipe.

As the connecting sections of flanges are caulked over the outer peripheries of the branched pipes, no welding process is needed for fixing. Further, as the grooves are provided for gas leakage prevention, the manifold will not leak gases even if the gas flowing therein is of high temperature and high pressure like exhaust gases.

DETAILED DESCRIPTION OF PREFERRED EMBODIMENT

The present invention will now be described by referring to the attached drawings.

Figure 1:
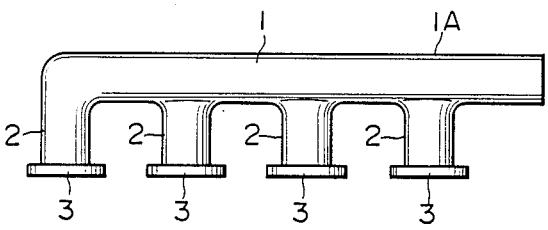
FIG. 1 is a frontal view to show an embodiment of the manifold according to this invention.

FIG. 1 shows an embodiment of this invention manifold applied to an exhaust manifold of an internal combustion engine wherein branch pipes 2 of a number corresponding to the number of cylinders of the internal combustion engine are projected by the bulging process from a side of a pipe member 1A, which forms a main body 1 of the manifold, in the direction perpendicular to the axial line of the pipe member 1A.

Figure 4:
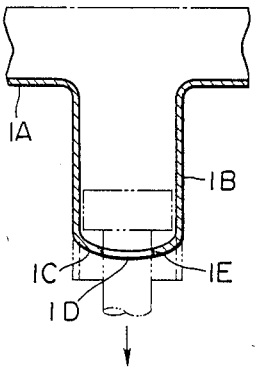
FIG. 4 is a cross-sectional view to show a forming process of a branch pipe.

The branch pipes 2 are formed as shown in FIG. 4 with the bulging process in a manner that a pipe member 1B is projected from a side of the pipe member 1A. After performing the bulging process, a hole 1D having a diameter slightly smaller than the internal diameter of the projected pipe 1B is bored on the end surface 1C of the pipe 1B, and the circumference 1E of the hole 1D is rectified to be straight with a burring die and cylindrical rod as shown with the dot-and-dash line.

Figure 5:
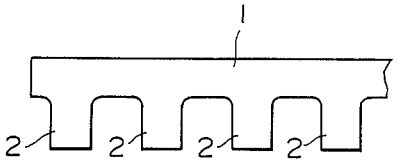
FIG. 5 is a frontal view to show a transformation of the manifold.

The branch pipe 2 is formed by bending a pipe member 1A in advance and then bulging the bent portions to enlarge the diameters. As shown in FIG. 5, however, all the branch pipes 2 may be formed by the bulging process.

The branch pipes 2 are attached at the ends thereof with flanges 3 for connection with cylinder blocks.

Figure 3:
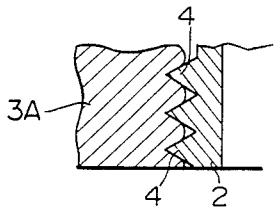
FIG. 3 is a partially enlarged cross-sectional view to show the state of caulking at the gas leakage prevention groove section of FIG. 2.
Figure 2:
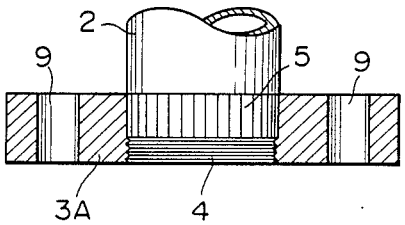
FIG. 2 is a cross sectional view of a flange of FIG. 1.

The flanges 3 are fixed on the branch pipes by caulking (pressure fitting) so as to be as shown in FIG. 2. More particularly, grooves 4 for gas leakage prevention and grooves 5 for rotation prevention are formed on one of the interface of the branch pipe 2 and the flange 3A which has the higher hardness (in the Figure, on the outer periphery of a branch pipe 2 at one end thereof) to caulk them together. As shown in FIG. 3 the grooves for gas leakage prevention are grooves in a plural number and in parallel to each other in circumferential direction of the outer periphery of the end portion of pipe 2 to have a serrated cross section.

The grooves for rotation prevention are provided in a plural number on the outer periphery of a branch pipe 2 in the axial direction or formed spirally or knurled thereon.

Figure 6:
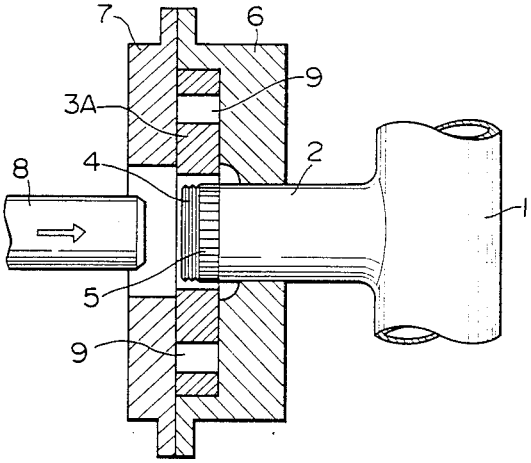
FIG. 6 is a cross-sectional view to show an embodiment of the caulking means for the flange members of FIG. 1.

In caulking, as shown in FIG. 6, a flange 3A is placed firmly at a predetermined position between holders 6,7, and an end of a branch pipe 2 is inserted at the center thereof so that the branch pipe 2 may be fixed immovably in the axial direction with a fixing means (not shown). A rod 8 is then forcibly inserted into the branch pipe 2 from one end thereof to expand the end portion thereof and caulk them as shown in FIG. 2.

As shown in enlargement in FIG. 3, the ridges of the grooves 4 for gas leakage prevention are forced into the internal periphery of the flange 3A, and both members are closely attached to each other. As this close attachment is generated on the plural ridges and grooves, and as adjacent grooves are completely independent of each other axially, the gas can fully be prevented from leaking from the pipe.

As the ridges of the grooves 5 for rotation prevention are similarly forced into the internal peripheral surface of the flange member 3A, the parts are also fixed integrally in rotation.

A flange member 3A is bored with bolt holes of a predetermined number to be attached to a cylinder block with bolts or other appropriate means.

EFFECT OF THE INVENTION

As described in detail in the foregoing statement, the main body and branch pipes of the manifold of the invention is integrally formed with a single pipe member and therefore the total weight can be remarkably reduced from the conventional manifolds which are cast-formed.

As this manifold is manufactured by bulging a pipe without using the casting process, it can be manufactured at lower cost and in smaller size.

As this manifold can be made smaller and compact, conditions heretofore restricting the layout design of an internal combustion engine may be removed to greatly facilitate the design.

As the flange and branch pipe are fixed by caulking, they can be attached to a cylinder block in a manner similar to the prior art. Since the flange is caulked via the grooves for gas leakage prevention, even if gas flows through the manifold at high temperature and under high pressure like an exhaust manifold, there is no possibility of gas leaking from the manifold. As the grooves for rotation prevention are provided, the connection between the flanges and branch pipes are further reinforced to ensure a solid and firm attachment as in the case of cast manifolds.

According to this manifold manufacturing method according to the invention, as branch pipes are formed with the bulging process, the manufacturing does not require the welding process and the productivity is therefore improved. Moreover, it is easy to form the connection of branch pipes smoothly to facilitate the flow of the gas and to achieve other various advantages.

What is claimed is:

1. A manifold comprising a main body formed with a pipe member, plural branch pipes projecting from one side of the pipe member in a direction perpendicular to the axis of the pipe member, and flanges mounted on the branch pipes at free ends thereof, circumferential gas leakage prevention grooves and rotation prevention grooves being formed on one of the outer peripheries of said branch pipes and the inner peripheries of said flanges and the outer peripheries of the branch pipes being caulked onto the inner peripheries of said flange.

2. The manifold as claimed in claim 1 wherein said branch pipes are integrally formed by a bulging process on one side of the pipe member.

3. The manifold as claimed in claim 1 wherein the gas leakage prevention grooves formed on one of the inner peripheries of the flanges and the outer peripheries of the branch pipes are plural grooves arranged in parallel to each other in the circumferential direction of the respective branch pipes and are serration-shaped in cross section.

4. The manifold as claimed in claim 1 wherein the rotation prevention grooves formed on one of the outer peripheries of the branch pipes and the inner peripheries of the flanges are one of plural grooves arranged in the axial direction of the branch pipes, spirally formed and knurled.

5. The manifold as claimed in claim 1 wherein the one of the flanges and the branched pipes on which the grooves are formed have a hardness higher than that of the other of the flanges and the branch pipes.

6. A method of manufacturing a manifold, comprising the steps of integrally forming plural pipe projections with a bulging process, projecting from one side of a pipe member in a direction perpendicular to an axial line of the pipe member, boring holes on ends of the pipe projections, forming branch pipes from the pipe projections by rectifying the circumference of the bored holes to form straight pipes, providing circumferential grooves for gas leakage prevention and grooves for rotation prevention on one of the outer peripheries of the branch pipes and the inner peripheries of flange members which are to be mounted on the ends of the branch pipes, and forming flanges on the branch pipes by forcibly caulking the outer peripheries of the branch pipes into the inner peripheries of the flanges members.

7. The method as claimed in claim6 wherein the step of forming the grooves for gas leakage prevention includes the step of providing plural grooves on one of the outer peripheries of the branch pipes and the inner peripheries of the flanges members which are to be mounted over the branch pipes in a plural number and in a circumferential direction so as to have a serrated cross section.

8. The method as claimed in claim6 wherein the step of forming rotation prevention grooves includes the step of forming on a surface one of knurls, plural grooves in the axial direction of the branch pipe, and spiral groove patterns.

9. The method as claimed in claim 6 wherein the one of the flange members and the branch pipes on which grooves are formed has a hardness higher than that of the other of the flange members and the branch pipes.

* * * * *